US011000749B1

(12) United States Patent
Forney

(10) Patent No.: US 11,000,749 B1
(45) Date of Patent: May 11, 2021

(54) GOLF PUTTING TRAINING DEVICES

(71) Applicant: Robert Forney, Johns Creek, GA (US)

(72) Inventor: Robert Forney, Johns Creek, GA (US)

( * ) Notice: Subject to any disclaimer, the term of this patent is extended or adjusted under 35 U.S.C. 154(b) by 0 days.

(21) Appl. No.: 17/037,832

(22) Filed: Sep. 30, 2020

Related U.S. Application Data

(60) Provisional application No. 62/907,936, filed on Sep. 30, 2019.

(51) Int. Cl.
*A63B 69/36* (2006.01)

(52) U.S. Cl.
CPC ..... *A63B 69/3667* (2013.01); *A63B 69/3682* (2020.08)

(58) Field of Classification Search
CPC ..... A63B 69/3667; A63B 69/3682
USPC ..... 473/218, 270–273, 261–265
See application file for complete search history.

(56) References Cited

U.S. PATENT DOCUMENTS 2,150,580 A * 3/1939 Crowley ..... A63B 69/3623 473/273
2,457,351 A * 12/1948 Crowley ..... A63B 69/3667 473/272
4,322,084 A * 3/1982 Reece ..... A63B 69/3667 473/273
4,384,718 A * 5/1983 Cachola ..... A63B 69/3667 473/218
4,718,674 A * 1/1988 Henry ..... A63B 69/3667 473/218
5,435,727 A * 7/1995 Dobson ..... A63B 69/3667 434/252
5,464,220 A * 11/1995 Hansen ..... A63B 69/3667 473/218
5,893,805 A * 4/1999 Douglass ..... A63B 69/3667 473/218
6,077,168 A * 6/2000 Huang ..... A63B 69/3667 473/218
7,037,210 B2 * 5/2006 Bainter ..... A63B 69/3667 473/270
8,696,484 B2 * 4/2014 Shahi ..... A63B 69/0057 473/257

* cited by examiner

*Primary Examiner* — Nini F Legesse

(57) ABSTRACT

Golf putting training devices are disclosed that include a toe line alignment rod that is perpendicularly connected to a lead foot alignment rod. The devices include a lead toe indicator rod, which is perpendicularly connected to the lead foot alignment rod through a first sliding connector. The devices also include a ball position indicator that is perpendicularly connected to the toe line alignment rod through a second sliding connector. The lead toe indicator rod and first sliding connector are configured to slide along an axis of the lead foot alignment rod to assist the golfer in identifying an optimal distance from a golf ball, while the ball position indicator and the second sliding connector are configured to slide along an axis of the toe line alignment rod to assist the golfer in identifying an optimal position of the golf ball relative to the golfer's left and right feet.

5 Claims, 6 Drawing Sheets

FIG. 6
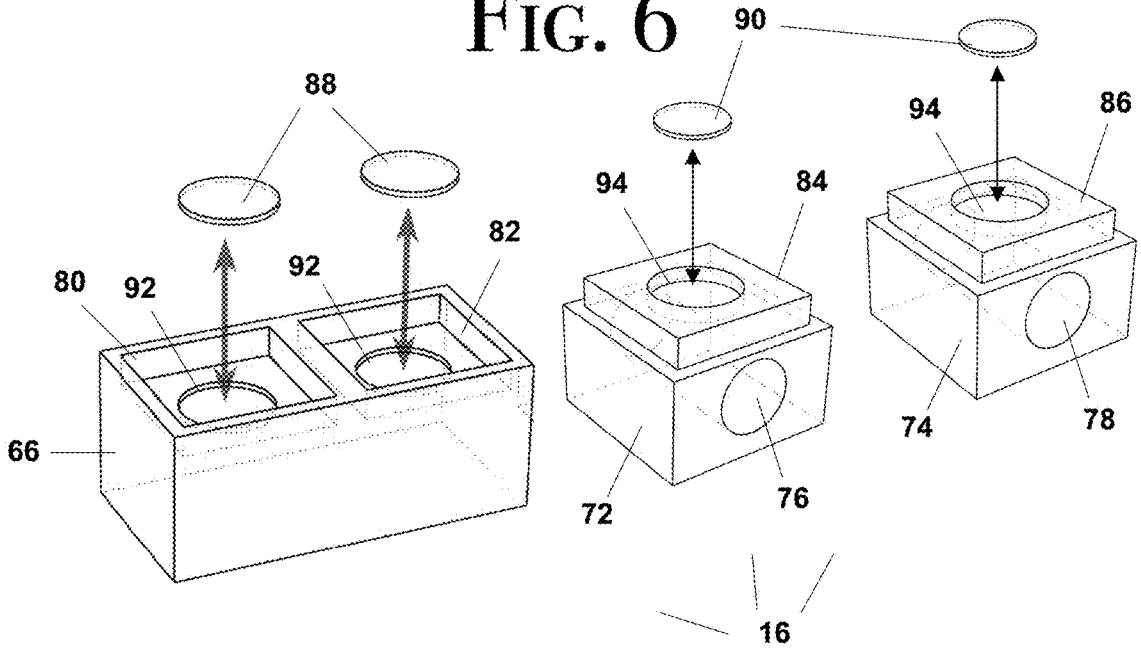
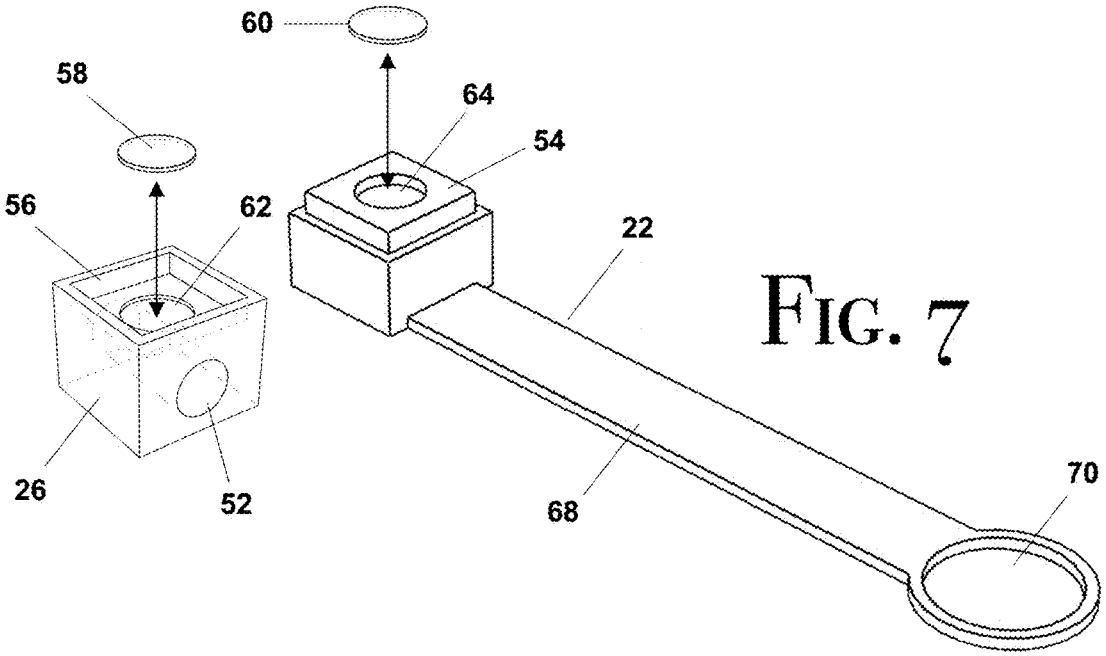
FIG. 7

GOLF PUTTING TRAINING DEVICES

CROSS-REFERENCE TO RELATED APPLICATIONS

This application claims priority to, and incorporates by reference, U.S. provisional patent application Ser. No. 62/907,936, filed on Sep. 30, 2019.

FIELD OF THE INVENTION

The field of the present invention relates to golf putting training devices and, more specifically, the present invention relates to golf putting training devices that assist with body alignment and ball position consistency.

BACKGROUND OF THE INVENTION

During a round of golf, when a golfer putts, the golfer will often place his/her golf ball in various positions within his/her stance (i.e., in various positions in relation to the golfer's left and right feet). Many golfers fail to place the ball in a consistent position, with variances occurring in how close the golfer is positioned to the ball, as well as the position of the ball between the golfer's left and right feet. In addition, many golfers struggle to accurately align their feet and shoulders toward the optimal target line towards the hole. Such inconsistency in golf ball position translates into poor putting results. Many putting training devices have been developed over the years. However, most devices do not effectively train a golfer to place a golf ball in a consistent location, particularly training devices that are easy to assemble, disassemble, and store in a golf bag.

As the following will demonstrate, the golf putting training devices described herein address such demands (and others) in the marketplace.

SUMMARY OF THE INVENTION

According to certain preferred aspects of the invention, golf putting training devices are provided. The devices generally include a toe line alignment rod, which is configured to be placed parallel to a desired target line on a putting green. The devices further include a lead foot alignment rod that is perpendicularly connected to the toe line alignment rod, wherein the lead foot alignment rod is configured to rest adjacent to a golfer's lead foot during putting (e.g., adjacent to the inside area of a right-handed golfer's left/lead foot). In addition, the devices include a lead toe indicator rod, which is perpendicularly connected to the lead foot alignment rod through a first sliding connector and is oriented to be parallel to the toe line alignment rod. Still further, the devices include a ball position indicator that is perpendicularly connected to the toe line alignment rod through a second sliding connector. The invention provides that the lead toe indicator rod and first sliding connector are configured to slide along an axis of the lead foot alignment rod to assist the golfer in identifying an optimal distance from a golf ball. In addition, the invention provides that the ball position indicator and the second sliding connector are configured to slide along an axis of the toe line alignment rod to assist the golfer in identifying an optimal position of the golf ball relative to the golfer's left and right feet.

The above-mentioned and additional features of the present invention are further illustrated in the Detailed Description contained herein.

BRIEF DESCRIPTION OF THE FIGURES

FIG. 6 is an illustration of the magnetic right angle connector described herein (in a disassembled view).

FIG. 7 is another illustration of the ball position indicator (and its associated connector) described herein.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to certain preferred embodiments of the present invention, golf putting training devices are provided that are particularly configured to train golfers to adopt correct and consistent ball alignment during putting (both in terms of distance from the ball and the position of the ball between a golfer's left and right feet). In addition, the training devices of the present invention are configured to be easily assembled, disassembled, and stored within a golfer's bag.

Figure 11:
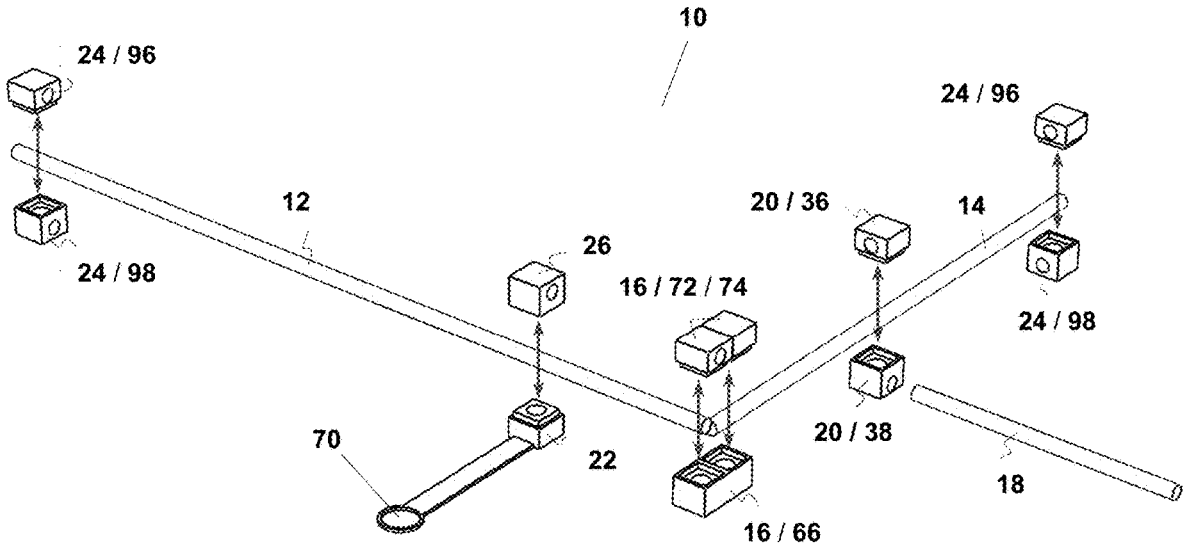
FIG. 11 is a disassembled view of the golf putting training devices of the present invention.
Figure 12:
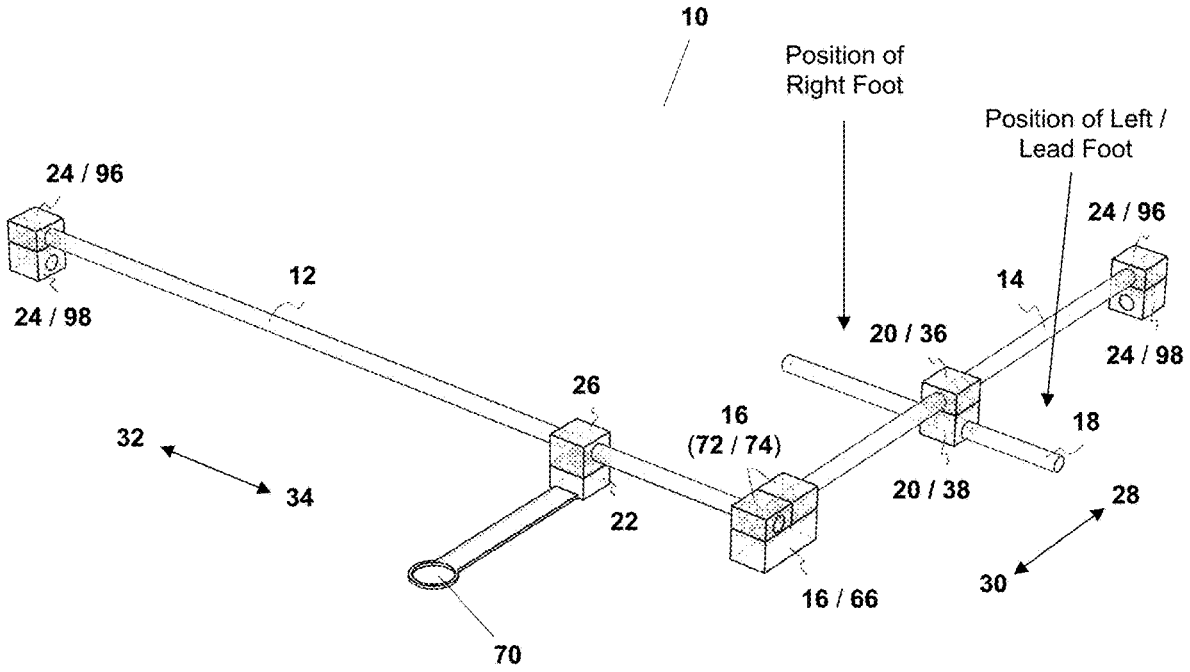
FIG. 12 is an assembled view of the golf putting training devices of the present invention.

Referring now to FIGS. 1-14, the golf putting training devices 10 include a series of rods and interchangeable connectors that may be easily and quickly assembled (and disassembled) by golfers. FIGS. 11 and 12 provide an illustration of the golf putting training devices 10 in disassembled and assembled views, respectively. The training devices 10 include a toe line alignment rod 12, which is placed parallel to a desired target line on a putting green. The desired target line may be identified and marked using a separate target alignment rod (not shown), i.e., a simple and well-known rod that golfers routinely place on the ground and use for proper body alignment, for both putting and full swing alignments. The training devices 10 further include a lead foot alignment rod 14 that is connected perpendicularly to the toe line alignment rod 12 through a magnetic right angle connector 16 (FIGS. 6 and 12).

According to such preferred embodiments of the present invention, the golf putting training devices 10 include a lead toe indicator rod 18, which is perpendicularly connected to the lead foot alignment rod 14 with a magnetic sliding connector 20 (the lead toe indicator rod 18 is oriented to be parallel to the toe line alignment rod 12). The golf putting training devices 10 further include a ball position indicator 22 that is perpendicularly connected to the toe line alignment rod 12 through connector 26. The training device 10 is leveled by having a rod stand end piece 24 positioned at the end of the toe line alignment rod 12 and at the end of the lead foot alignment rod 14 (i.e., at the ends opposite of the magnetic right angle connector 16). Once the training device 10 is assembled, a golfer can then slide the lead toe indicator rod 18 in directions 28 and 30 along the axis of the lead foot alignment rod 14 to adjust his/her distance from the ball (which will be placed within the loop 70 of the ball position indicator 22)(FIG. 12). Similarly, the ball position indicator 22 may also be moved (in directions 32 and 34) by sliding the ball position indicator 22 along the axis of the toe line alignment rod 12 to the desired position. The following will describe each of the foregoing rods and connectors in further detail.

Figure 1:
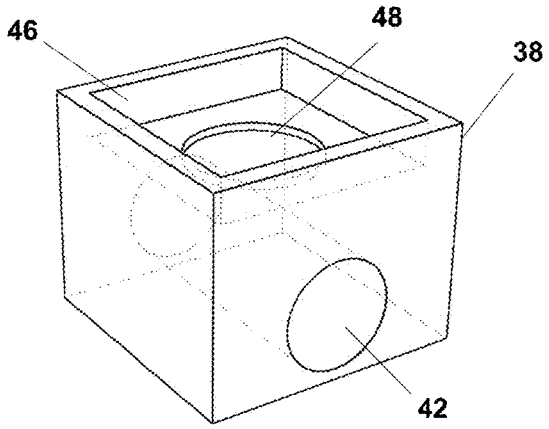
FIG. 1 is an illustration of the bottom block of the magnetic sliding connector described herein.
Figure 2:
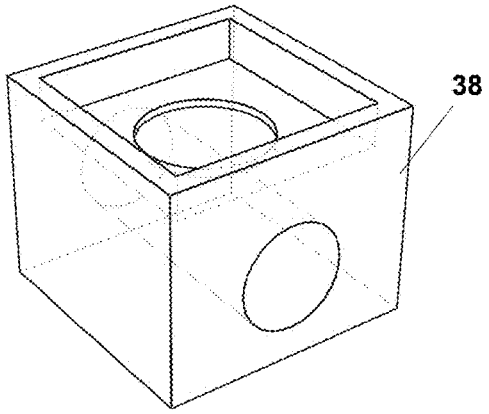
FIG. 2 is another illustration of the bottom block of the magnetic sliding connector described herein.
Figure 3:
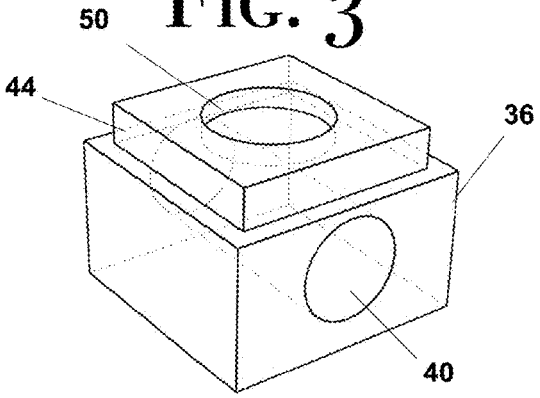
FIG. 3 is an illustration of the top block of the magnetic sliding connector described herein.
Figure 4:
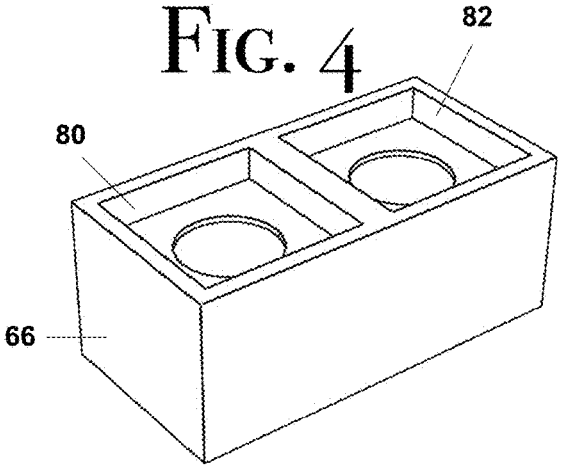
FIG. 4 is an illustration of the dual bottom block of the magnetic right angle connector described herein.
Figure 5:
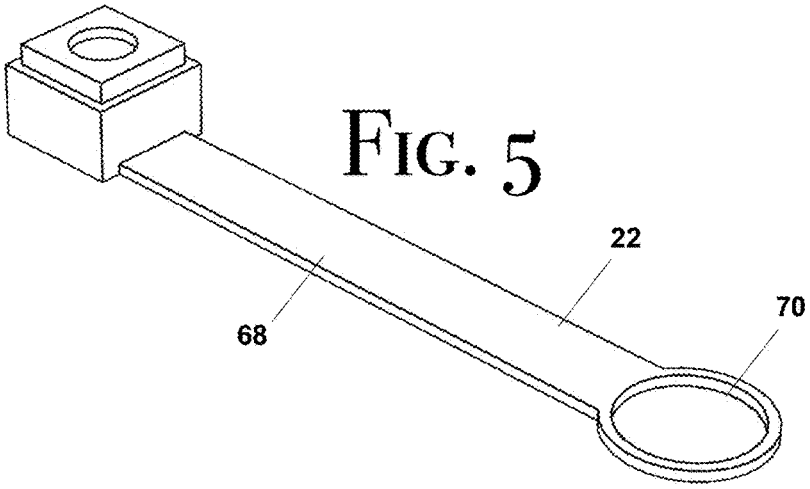
FIG. 5 is an illustration of the ball position indicator described herein.
Figure 8:
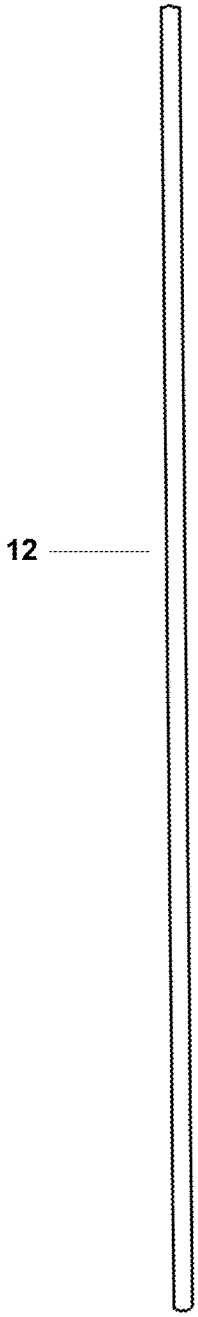
FIG. 8 is an illustration of the toe line alignment rod described herein.
Figure 9:
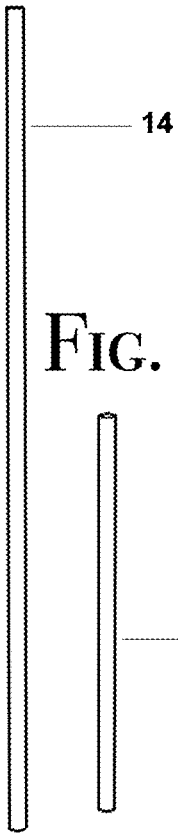
FIG. 9 is an illustration of the lead foot alignment rod described herein.
Figure 10:
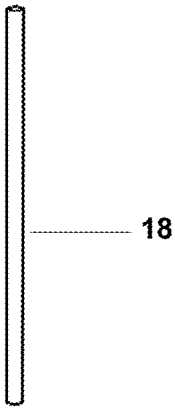
FIG. 10 is an illustration of the lead toe indicator rod described herein.

As mentioned above, during assembly, the lead toe indicator rod 18 is connected to the lead foot alignment rod 14 through a magnetic sliding connector 20. The magnetic sliding connector 20 (FIG. 12) includes two parts, namely, a top block 36 (FIG. 3) and a bottom block 38 (FIGS. 1 and 2). The top block 36 includes an aperture 40 that is configured and dimensioned to receive and hold the lead foot alignment rod 14. The invention provides that the aperture 40 will be dimensioned to securely hold the lead foot alignment rod 14, while allowing sufficient space to allow the lead toe indicator rod 18 to be moved in directions 28 and 30 along the axis of the lead foot alignment rod 14 (FIG. 12). The bottom block 38 (FIG. 1) also includes an aperture 42 that is configured and dimensioned to receive and hold the lead toe indicator rod 18.

According to certain preferred embodiments, the top block 36 is configured to be reversibly connected to the bottom block 38 by inserting and positioning a protruding surface 44 into a correspondingly configured cavity region 46 of the bottom block 38, i.e., such that the top block 36 can be mechanically attached to the bottom block 38 (or snapped together). More particularly, in certain embodiments, the protruding surface 44 will exhibit a rectangular dimension that is configured to mate with, and fittingly reside within, the cavity region 46 of the bottom block 38. The invention provides that the top block 36 and bottom block 38 may be further secured to each other (in a reversible manner) through a set of magnets positioned within adjacent regions 48/50. The invention provides that the top block 36 is configured to be reversibly connected to the bottom block 38 in such a way that the apertures 40/42 are positioned perpendicular to each other, such that the lead foot alignment rod 14 and the lead toe indicator rod 18 are also positioned perpendicular to each other (as shown in FIG. 12).

As mentioned above, during assembly, the ball position indicator 22 (FIGS. 5 and 7) is connected to the toe line alignment rod 12 through connector 26 (FIG. 7). The invention provides that the connector 26 will include an aperture 52 that is configured and dimensioned to receive and hold the toe line alignment rod 12. The invention provides that the aperture 52 will be dimensioned to securely hold the toe line alignment rod 12, while allowing sufficient space to allow the connected ball position indicator 22 to be moved in directions 32 and 34 along the axis of the toe line alignment rod 12 (FIG. 12). The invention provides that the ball position indicator 22 includes a protruding surface 54 (on the top surface thereof) that is configured to be inserted into a correspondingly configured cavity region 56 of connector 26. More particularly, as shown in FIG. 7, the protruding surface 54 will exhibit a rectangular dimension that is configured to mate with, and fittingly reside within, the cavity region 56 of the connector 26. The invention provides that the ball position indicator 22 and connector 26 may be further secured to each other (in a reversible manner) through a set of oppositely polarized magnets 58/60 positioned within adjacent regions 62/64. According to certain preferred embodiments, the ball position indicator 22 includes an integrally connected arm 68, which has a distal end that includes a distal loop 70 that is configured to position a golf ball during use of the training device 10. The loop 70 will preferably exhibit a flat/thin dimension to avoid any disruption to the roll of a golf ball.

As mentioned above, the invention provides that the lead foot alignment rod 14 is connected perpendicularly to the toe line alignment rod 12 through a magnetic right angle connector 16 (FIGS. 6 and 12). The magnetic right angle connector 16 includes a series of components, namely, a dual bottom block 66 and two top blocks 72/74 (FIG. 6). In such embodiments, a first top block 72 includes an aperture 76 that is configured to receive and hold an end of the lead foot alignment rod 14. Similarly, the second top block 74 includes an aperture 78 that is configured to receive and hold an end of the toe line alignment rod 12. In addition, according to certain preferred embodiments, the dual bottom block 66 includes a set of two cavity regions 80/82, which are configured mate with, and fittingly receive, two corresponding protruding surfaces 84/86 of the two top blocks 72/74, respectively. As with the other embodiments described herein, the dual bottom block 66 and two top blocks 72/74 may further include a set of oppositely polarized magnets 88/90 positioned within adjacent regions 92/94, which can be used to further secure the dual bottom block 66 to the two top blocks 72/74. The magnets described herein may be affixed to the target regions through adhesives, mechanical attachment means, welding, or other methods.

Figure 13:
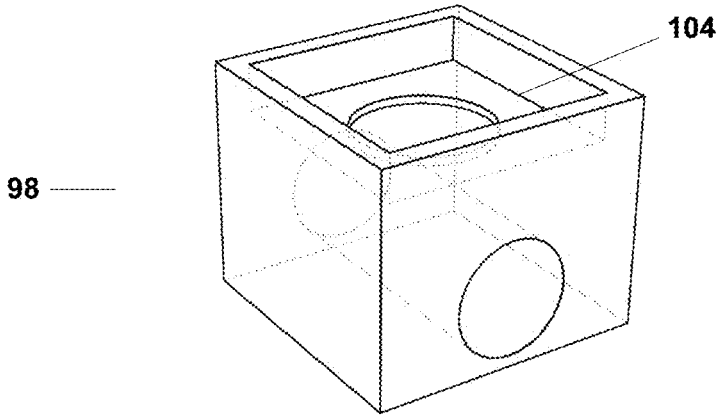
FIG. 13 is an illustration of the bottom block of the rod stand end piece described herein.
Figure 14:
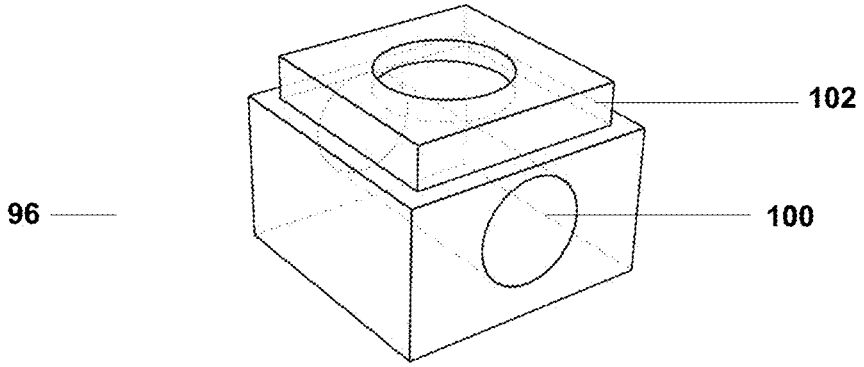
FIG. 14 is an illustration of the top block of the rod stand end piece described herein.

As also mentioned above, the training devices 10 are leveled by having a rod stand end piece 24 positioned at the end of the toe line alignment rod 12 and at the end of the lead foot alignment rod 14. The invention provides that each rod stand end piece 24 includes two components, namely, a top block 96 (FIG. 14) and a bottom block 98 (FIG. 13). The top block 96 includes an aperture 100 that is configured and dimensioned to receive and hold an end of the lead foot alignment rod 14 (or an end of the toe line alignment rod 12)—the two top blocks 96 and the two bottom blocks 98 (of the two rod stand end pieces 24) are preferably interchangeable, such that they are configured to serve as the rod stand end piece 24 for either the lead foot alignment rod 14 or the toe line alignment rod 12. As with the other embodiments described herein, the top block 96 includes a protruding surface 102 that exhibits a rectangular dimension that is configured to mate with, and fittingly reside within, a cavity region 104 of the bottom block 98. Likewise, as with the other embodiments described herein, the top blocks 96 and bottom blocks 98 may be further secured to each other with oppositely polarized magnets.

Once the golf putting devices 10 of the present invention are assembled, a golfer will position the golf putting device 10 parallel to a target line alignment rod. More specifically, the toe line alignment rod 12 will be positioned to be parallel to a desired target line (which may optionally be marked with the separate target alignment rod mentioned above). The golfer's left toes (for a right-handed golfer) are placed immediately adjacent to the axis of the lead toe indicator rod 18—and the left/interior side of the golfer's left foot is positioned adjacent to the lead foot alignment rod 14 (See FIG. 12). The golfer may then adjust the lead toe indicator rod 18 (along the axis of the lead foot alignment rod 14), as described herein, such that the golfer is positioned at a desired distance from the ball. In addition, the ball position indicator 22 is moved to the golfer's desired position (relative to the golfer's left and right foot), along the axis of the toe line alignment rod 12.

The golfer then putts a ball along the intended target line and watches how his/her stroke causes the ball to roll from the original position (i.e., the original position being within the loop 70 of the ball position indicator 22). If the ball exhibits an outward skid, such movement will usually indicate the golfer's putter face is open at impact, whereupon the ball position indicator 22 should be moved more forward (towards the left foot of a right-handed golfer) to give the golfer more time for the putter face to strike the ball during the stroke with a more square face. Conversely, if the ball has an inward skid, such movement will usually indicate the golfer's putter face is closed at impact, whereupon the ball position indicator 22 should be moved more backward (towards the right foot of a right-handed golfer), to facilitate the putter face striking the ball during the stroke with a more square face. Thus, as experienced golfers are aware, positioning the ball too far forward produces a tendency for the face of the putter to close, while positioning the ball too far back in the stance produces a tendency for the putter face to be open during impact (since most putting strokes exhibit a slight arcing motion).

Once the optimal ball position is identified, which is indicated by the golf ball rolling end over end without any side skid, a golfer may label the positions of (A) the ball position indicator 22 (at the optimal location along the toe line alignment rod 12) and (B) the lead toe indicator rod 18 (at the optimal location along the lead foot alignment rod 14). Such labels may be applied using tape, markers, scoring, or other devices and methods. Once such optimal positioned are identified, the golf putting device 10 may be used by golfers to train their bodies (and minds) to position the ball at the same/consistent location—both in relation to their feet and distance from the golf ball. Importantly, although the golf putting device 10 is described and illustrated herein to be operated by a right-handed golfer, the golf putting device 10 is configured to be assembled in a way that also accommodates a left-handed golfer, e.g., by essentially assembling the golf putting device 10 in a way such that the ball position indicator 22 and lead foot alignment rod 14 are rotated 180-degrees from the positions illustrated herein.

The invention provides that the golf putting training device 10 and the components thereof may be manufactured from any of various metals, alloys, plastics, wood, combinations thereof (and/or other suitably rigid materials). The invention provides that such components may be manufactured through known injection molding techniques and/or through three-dimensional (3D) printing. The invention further provides that although the rods described herein are shown to be cylindrical in shape (e.g., the toe line alignment rod 12, the lead foot alignment rod 14, and the lead toe indicator rod 18), the invention provides that such components may alternatively exhibit a rectangular cross-section, provided that the corresponding apertures described herein are modified to also exhibit a similar cross-section to achieve the same functionality. Similarly, although the connectors/blocks described herein (e.g., the rod stand end pieces 24, the connector 26, the magnetic right angle connector 16, and the magnetic sliding connector 20) are shown to exhibit a square cross-section, the invention provides that such elements could alternatively exhibit other shapes, e.g., a cylindrical shape, provided that the function described herein is maintained.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A golf putting training device, which comprises:

(a) a toe line alignment rod, which is configured to be placed parallel to a desired target line on a putting green;

(b) a lead foot alignment rod that is perpendicularly connected to the toe line alignment rod, wherein the lead foot alignment rod is configured to rest adjacent to a golfer's lead foot during putting;

(c) a lead toe indicator rod, which is (i) perpendicularly connected to the lead foot alignment rod through a magnetic sliding connector and (ii) oriented to be parallel to the toe line alignment rod; and (d) a ball position indicator that is perpendicularly connected to the toe line alignment rod, wherein:

(i) the lead toe indicator rod and magnetic sliding connector are configured to slide along an axis of the lead foot alignment rod to assist the golfer in identifying an optimal distance from a golf ball;

(ii) the ball position indicator is configured to slide along an axis of the toe line alignment rod to assist the golfer in identifying an optimal position of the golf ball relative to the golfer's left and right feet; and (iii) the magnetic sliding connector comprises a first top block and a first bottom block, wherein the first top block includes a first aperture that is configured to receive and hold the lead foot alignment rod; the first bottom block includes a second aperture that is configured to receive and hold the lead toe indicator rod; the first top block includes a protruding surface that is configured to mate with, and fittingly reside within, a cavity region of the first bottom block; and the first top block and the first bottom block are further secured to each other through a pair of magnets.

2. The golf putting training device of claim 1, wherein the ball position indicator is perpendicularly connected to the toe line alignment rod through a connector that comprises (a) a third aperture that is configured to receive and hold the toe line alignment rod and (b) a cavity region that is configured to receive and mate with a protruding surface of the ball position indicator.

3. The golf putting training device of claim 2, wherein the ball position indicator includes an integrally connected arm, which has a distal end that includes a loop that is configured to position the golf ball during use of the golf putting training device.

4. The golf putting training device of claim 3, wherein the lead foot alignment rod is connected perpendicularly to the toe line alignment rod through a magnetic right angle connector, wherein the magnetic right angle connector comprises a dual bottom block, a second top block, and a third top block, wherein:

(a) the second top block includes a fourth aperture that is configured to receive and hold a first end of the lead foot alignment rod;

(b) the third top block includes a fifth aperture that is configured to receive and hold a first end of the toe line alignment rod; and (c) the dual bottom block includes a set of two cavity regions, which are configured to mate with, and fittingly receive, two corresponding protruding surfaces of the second top block and third top block.

5. The golf putting training device of claim 4, which further comprises a first rod stand end piece positioned at a second end of the toe line alignment rod and a second rod stand end piece positioned at a second end of the lead foot alignment rod.

* * * * *